US005816618A

United States Patent [19]

Jarasse

[11] Patent Number: 5,816,618

[45] Date of Patent: Oct. 6, 1998

[54] DOCUMENT CAPABLE OF BEING DISMANTLED, TRANSPORTED AND STORED IN SEPARATE INTERCONNECTABLE PORTIONS

[76] Inventor: Michel Andre Jarasse, Regeat, Couffy/Sarsonne, F-19340 Eygurande, France

[21] Appl. No.: 731,383

[22] Filed: Oct. 11, 1996

Related U.S. Application Data

[63] Continuation of PCT/FR95/00453, Apr. 10, 1995.

[30] Foreign Application Priority Data

Apr. 11, 1994 [FR] France ..... 94 04210
Jun. 16, 1994 [FR] France ..... 94 07395

[51] Int. Cl.[6] ..... B42D 1/00

[52] U.S. Cl. ..... 281/28; 281/21.1; 281/38; 281/36

[58] Field of Search ..... 283/117; 281/15.1, 281/21.1, 36, 38, 46, 47

[56] References Cited

U.S. PATENT DOCUMENTS

| | | | |
|---|---|---|---|
| 1,020,995 | 3/1912 | Leeds | 281/46 |
| 1,461,669 | 7/1923 | Martin . | |
| 2,127,619 | 8/1938 | Rosenthal . | |
| 4,426,007 | 1/1984 | Beleckis et al. | 281/46 X |

FOREIGN PATENT DOCUMENTS

| | | |
|---|---|---|
| 878684 | 1/1943 | France . |
| 1232542 | 10/1960 | France . |
| 1564011 | 4/1969 | France . |
| 2141326 | 1/1973 | France . |
| 718 684 | 2/1942 | Germany . |
| 452 477 | 5/1968 | Switzerland . |
| 725068 | 3/1955 | United Kingdom . |
| 1 543 912 | 4/1979 | United Kingdom . |
| 2 051 683 | 1/1981 | United Kingdom . |

*Primary Examiner*—Willmon Fridie, Jr.
*Attorney, Agent, or Firm*—Young & Thompson

[57] ABSTRACT

A connected document such as a school book, catalog, etc . . . separable in independent detachable portions, so as not be have to transport but the useable portion or portions to be able to file, reclassify, replace, complete these independent subassemblies without having to manipulate all of the document, comprised by a cover and detachable portions (1) such as notebooks, magazines, pockets for loose-leaves, provided with securement elements coacting in a detachable manner with complementary reception elements secured to the cover of the document, characterized by the use, to ensure the securement of the detachable portions (1), of staples (2) or pins (3) secured to the back of these portions (1) by the use of resilient receives (4) fixed within the back of the cover, in combination with recesses (5) provided in the staples (2) or pins (3) adapted to be engaged in the receivers (4).

23 Claims, 6 Drawing Sheets

DOCUMENT CAPABLE OF BEING DISMANTLED, TRANSPORTED AND STORED IN SEPARATE INTERCONNECTABLE PORTIONS

This application is a continuation of international application PCT/FR95/00453 filed April 10, 1995, which designated the United States.

FIELD OF THE INVENTION

The present invention is a device permitting the separation of a book, a file, a binder, etc . . . , into plural separable sections, to permit its transportation, handling, modification, replacement, etc . . . , of these portions, then their re-emplacement to reconstitute the original document.

BACKGROUND OF THE INVENTION

The present invention is particularly adapted to lighten the weight of documents transported from their storage place to their work site by scholars and students, by commercial representatives, by persons working at the work places, etc . . .

For example, the weight of the school bag of a $4^{th}$ year student at present is between 9 and 14 Kg, which is an excessive weight and is the object of numerous complaints from parents and children and appears to be the origin of numerous back problems.

In the state of the art, a costly remedy is a double set of books (school-home) and the use of loose-leaves which can be lost or damaged.

Certain solutions described in the search report of prior art have been proposed to interconnect magazines, written documents, loose-leaves, into detachable sections protected by a common back, the connection taking place with the aid of Velcro (Swiss 45 24 77), with the aid of a dovetail mechanism (U.S. Pat. No. 2,127,619), with the aid of a metal pin or buckle inserted in a certain type of resilient receiver (2,141,326), or with the aid of pins retained by straps (878,684).

SUMMARY OF THE INVENTION

The present invention is distinguished from these embodiments as to certain points. As to school material: one can use a single set of books, loose-leaf binders, without loose-leaves. Relative to the use of Velcro: for reliability, long life, small thickness, the use of loose-leaves is possible. Relative to the use of a dovetail: for small thickness, the use of loose-leaf is possible. Relative to a metallic buckle: for simplicity one can use a staple which does not extend outwardly and can serve for pinning the documents and insertable resilient receivers. Relative to the use of straps: simplicity of handling is evident.

The best embodiment is, except in particular cases, that of FIG. 1 with a rigid back, which is to say without the device 10 and in combination with the staple 2 of FIG. 2.

The present invention offers an alternative to certain existing office materials such as binders, computer listings, systems of which the separable portions are provided with projections, bundling systems, binders for holding magazines, periodicals, storage and classification of loose-leaves, etc . . .

The present invention permits considerable lightening of documents to be carried (division of weight of the average school book by about 8 times) by a device for separating the documents in multiple portions easily handled that can be separated or reassembled at will. According to the more or less intense use of these separable portions, according to their destination, they could be provided with a protective cover and an indexing system (to avoid the drawbacks of a binder).

The device according to the invention makes possible the emplacement of loose-leaves in the cover of the detachable portions without it being necessary that the sheets be doubled for the passage of a pin nor that the cover of the detachable portions be closed on two sides (as in the bundling systems), nor on three sides. It is also possible to provide pins through the sheets to form the equivalent of a notebook or a magazine.

The separation into separate portions renders the extraction and replacement of sheets or separate notebooks more easily than in the case of a binder or a computer listing with pins, in a single block.

The device according to the invention has no projecting portions at the back of the movable portions and permits their easy use open on a table such as a notebook or an ordinary magazine.

In the reassembled position, the device according to the invention can have the appearance and size of a book and be used as such, maintaining in particular the quality of the printing of photos, drawings and presentation, also ensuring a certain positioning of the different paragraphs. In the detachable position, each portion can have the quality and arrangement of a magazine.

The device according to the invention can be associated with carrying or arranging means especially designed to facilitate its use. The device comprises detachable portions 1, FIGS. 1, 2, 3, 4, 5, 10, 11, 15, 20, 22, 23 provided with insertion or holding means as well as one or several indexing means of their exact positions, Figs, 20, 21, 22, a cover which is suitable and complementary to the insertion means, the whole associated or not with carrying or arranging means, FIGS. 23, 24, 25.

DESCRIPTION OF THE PREFERRED EMBODIMENT

Figure 1:
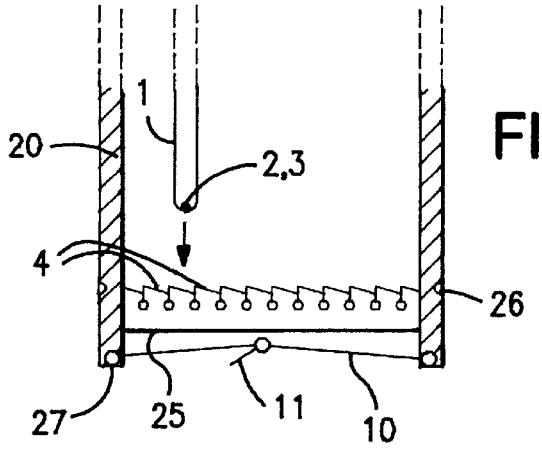
FIG. 1 is a side view of the binder showing a detachable portion being inserted in the back of the binder.

According to the embodiments:

A required number of detachable portions 1 are present in the form of notebooks, magazines, means to receive loose-leaves or leaves already connected in one way or another are also provided. A cover 20, FIGS. 1, 11, 13, 15, is adapted to connect the detachable portions 1. The connection is made by staples 2, FIGS. 2, 10, 15, 16, 19, 21, or pins 3, FIGS. 3, 4, 15, 16, 19, secured to the detachable portions 1 in combination with suitable receivers 4, FIGS. 1, 6, 7, 8, 9, 10, 11, 12, 13, 14, 15, 16, 17, 18, 19, secured to the cover forming the general binder, thanks to recesses 5, FIGS. 2, 3, 4, 5, 10, in the detachable portions 1 permitting the passage of said receivers 4. The cover 20 can bend at 26, FIGS. 1, 11, 13, 14, 15, for handling.

For each detachable portion, the staples 2 or pins 3 can serve to maintain together the sheets associated therewith, and hence to replace the screw-threaded pin or staples, in the case of internal notebooks of 32 or 64 pages of a school book in particular. The staples or pin can maintain only a portion of the sheets or quite simply the outermost sheet forming the cover of the detachable portion, or again can serve as a connection for a cover having a gripping system for the loose-leaves or groups of leaves.

Various materials, paper, cardboard, PVC, polypropylene, Rhodoid, etc . . . can be used for this internal cover according to whether a greater resistance to wear and to handling, or a greater flexibility is sought, analogous to that of pages of a book to reproduce as faithfully as possible a conventional book. To take account simultaneously of the constraints which arise, there can be provided reinforcements at the points of attachment, thickening of the paper, gummed corners, etc . . . , or else the more or less flexible rendering of the cover of the detachable material and the points of attachment, if desired by a printing process, before or after printing of the text to be disposed in the detachable portion, or better at the same time. Moreover, these internal covers may be as needed open on three sides, for example notebooks, two sides as in the bundling systems, one side being in the form of a pocket.

Figure 2:
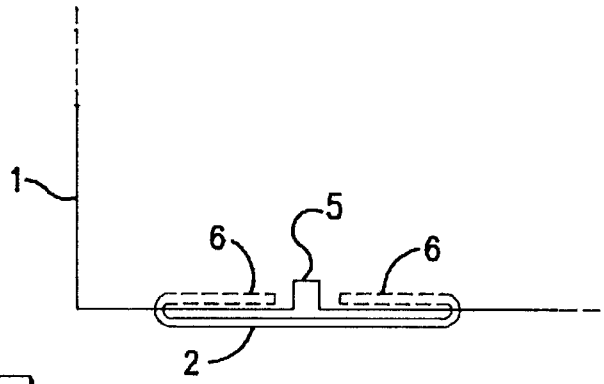
FIGS. 2, 3, 4 and 5 show the connection means secured to the detachable portions.
Figure 3:
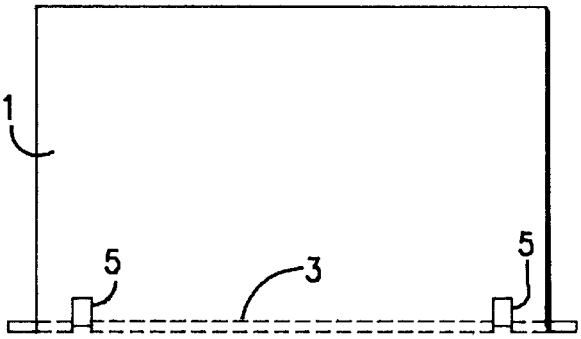

The staples 2 secured to the detachable portions 1 and serving if desired for holding them together have preferably their ends 6, FIG. 2, bent inwardly of the detachable portions, the ends being separated by a space at least equal to the width of the recess 5 adapted for the passage of the corresponding receiver in the general binder, space which is also adapted for the passage of the receiver. (Two or more staples per detachable portion, namely a central station or even a single station occupying almost all the length, permitting the uncoupling of the detachable portion with a single movement).

Figure 4:
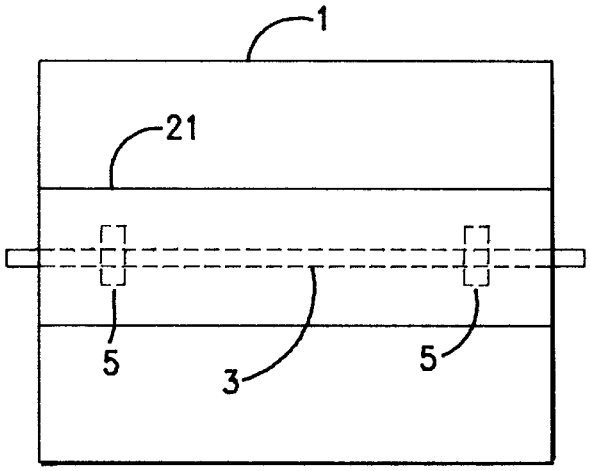
Figure 5:
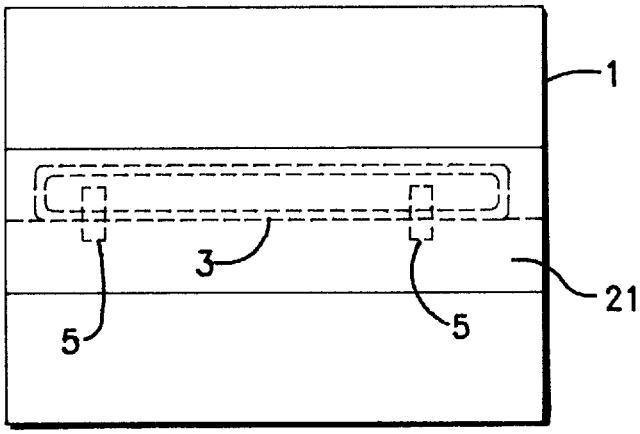

A pin 3 disposed longitudinally in a fold of a detachable portion can be secured by an adhesive strip, by a glued strip 21, FIGS. 4, 5, by stitched threads, and have the same connecting function as the receivers 4 of the cover of FIG. 1 as the staples 2 previously described. To be compatible with existing systems and to permit storage of the detachable portions not only with the present invention but also with existing means, the pin could extend beyond the ends of the detachable portions as in certain known embodiments (engagement in the bridges of the bundle systems) but could, thanks to the recesses of the detachable portions, engage also in receivers of the overall cover of the present invention. The pins can be rigid, outwardly extending and adapted to be engaged at each end in said receivers. A compromise between rigidity and flexibility can be sought for the outwardly extending pins, rendering them adapted to be engaged in receivers 4 thanks to the recesses 5 or by their ends, as well as in the bridges of the bundle system to permit compatibility between the two systems. The pins can be bent back in loops for more solid securement, can be of circular section at the bend of the sheet and of the receivers and flattened in the rest of the loop so as not to be too thick, FIG. 5.

Figure 6:
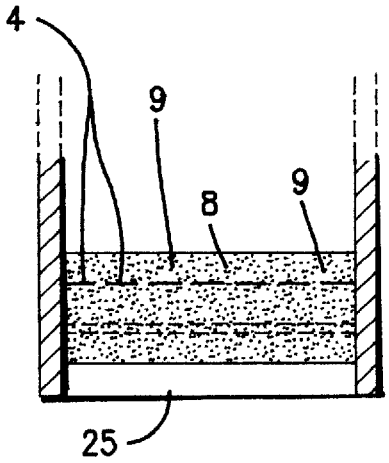
FIG. 6 shows, from above, the interior of the back of the binder and the arrangement at one end of this back of resilient receivers of metallic wire.
Figure 7:
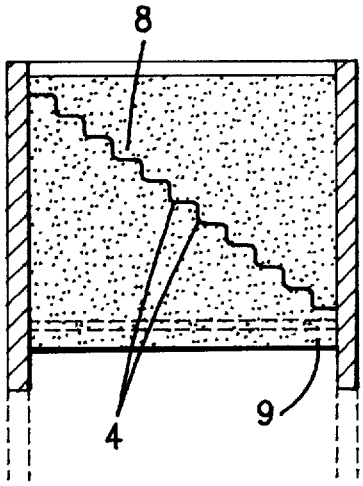
FIG. 7 is the same with resilient sheet metal or molded plastic receivers, in spaced position.
Figure 7:
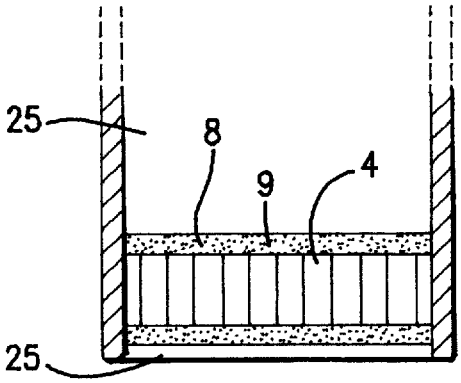
Figure 9:
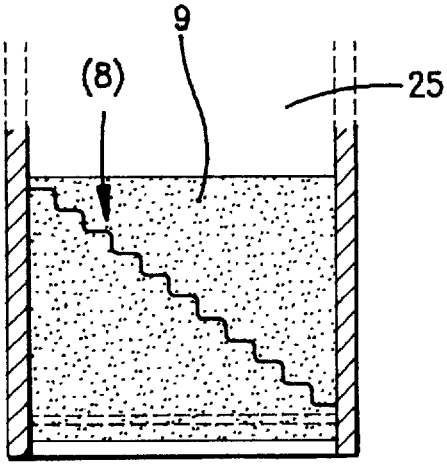
FIG. 9 is the same but the two ends of the back are provided with elastic carrying receivers of metallic wire, in the spaced position.
Figure 8:
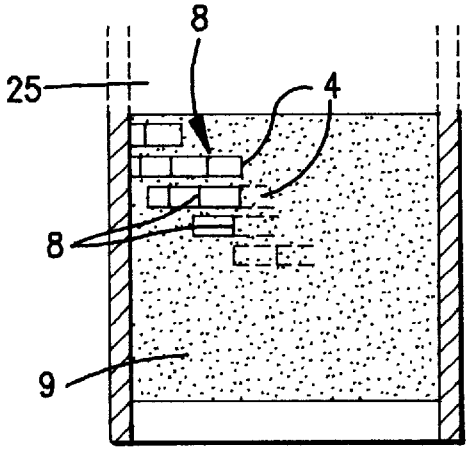
FIG. 8 is a top plan view of the receivers in spaced position.
Figure 10:
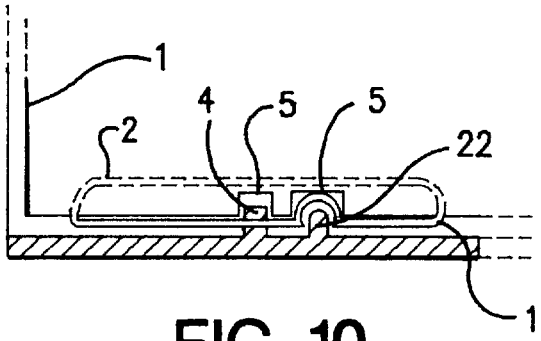
FIG. 10 shows a modification of the staple shown in FIG. 2.

The recesses can be provided in each detachable portion and in this case, the receivers and the overall cover will be aligned at each end of this cover, for example FIGS. 6 and 7, seen from above. But these recesses can also be provided at different points for each detachable portion, the corresponding receivers will then be separated, for example along a diagonal as in the top plan views of FIGS. 8 and 9, as well as each detachable portion having a single position in the overall binder, these two portions cannot be inverted (given the order of the paragraphs of a work).

The recesses 5, if their width corresponds to the thickness of the receivers of the overall cover, can ensure the positioning of the detachable portions (at the same place) and avoid their sliding in the direction of the length of this cover. The positioning can also be achieved by thickeners 22 or pieces connected to the internal portion of the back of the overall cover, wedging the ends of the detachable portions or corresponding to a particular configuration of the staples, FIG. 10.

Figure 11:
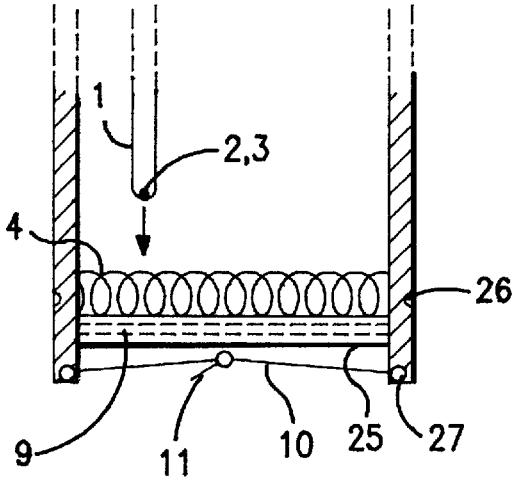
FIG. 11 is a side view of the binder provided with resilient sheet metal or metallic wire receivers.
Figure 12:
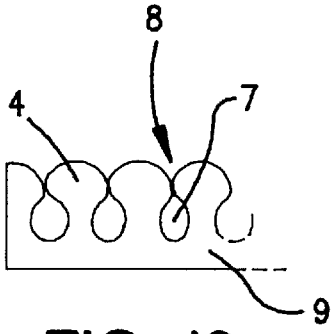
FIG. 12 shows a modification of molded plastic resilient receivers.

The receivers 4 secured to the overall cover in which the staples 1 or pins 3 must be engaged, can be made of various resilient materials, plastic material, steel wire, FIG. 11, thin sheet metal, etc . . . A receiver has a space 7, FIGS. 1, 12, 13, 15, 16, 17, 18, 19, to receive the staple or pin of a slot 8, FIGS. 1, 12, 13, for the passage of this staple or pin. The slot can have a joining edge 8, FIG. 12, or else a calibrated thickness. The resilience of the material of the receiver and its shape in the case of a slot with joining edges, the elasticity and the width of the slot in the second case, are calculated to ensure the best compromise possible between the force to be exerted for the passage of the staple or pin and the effective maintenance of the detachable portions in place in the overall binder during manipulations such as consulting a bound document. The receivers could if desired have several fixed positions for a same detachable portion or be mounted on slides to be able to receive detachable portions of unequal thicknesses, provided with empty spaces to receive other objects than documents.

Figure 14:
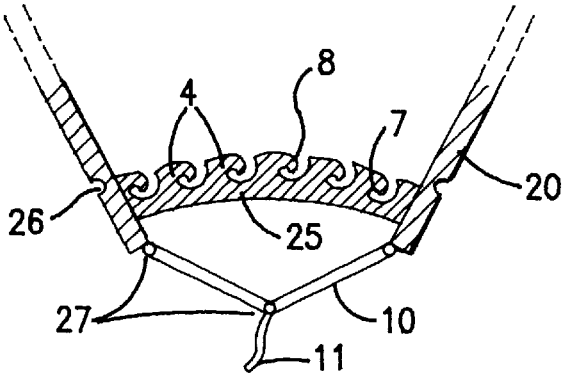
FIG. 14 is a side view of the back of the binder provided with a modification of J shape of the elastic receivers.
Figure 13:
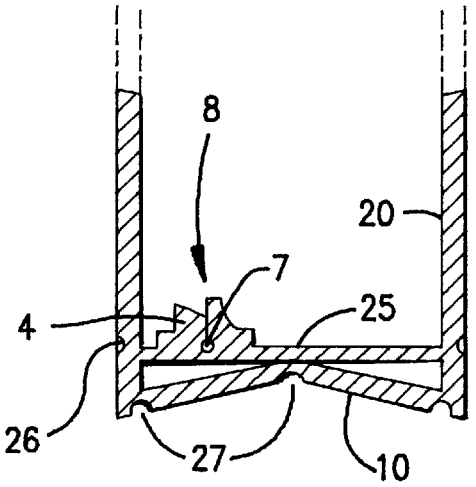
FIG. 13 shows a side view of the back of the binder in injectable material in a single piece (a single one of the elastic receivers is shown).

The receivers can be molded in a block with the back of the cover, FIGS. 13, 14.

The receivers can be disposed on one or more plates 9, FIGS. 6, 7, 8, 9, secured by cementing, welding, riveting, etc . . . with the back of the overall cover or else molded in one piece with a portion of or all of this binder.

Figure 16:
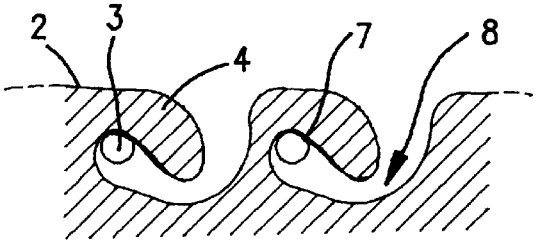
FIGS. 16 and 18 show elastic receivers of J shape. These receivers need not be elastic if a strip of elastic material is arranged suitably to maintain the connecting member secured to the detachable portions, as shown in FIG. 19.
Figure 17:
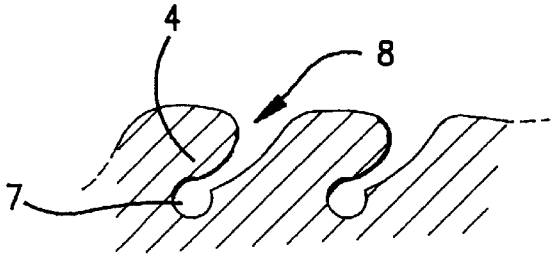
FIG. 17 shows a modification of elastic receivers.
Figure 18:
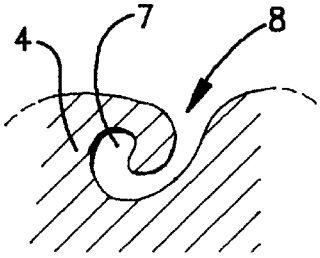
Figure 19:
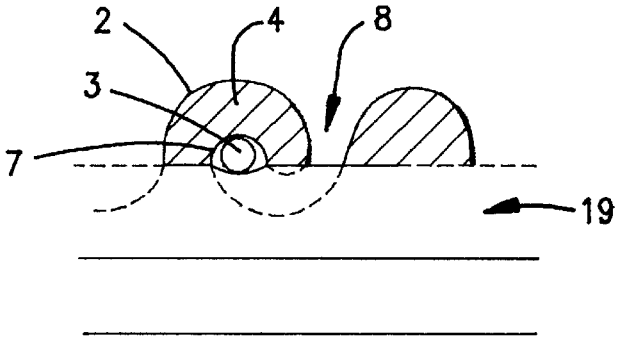

The slot permitting the passage of the staple or pin into a resilient receiver is generally disposed vertically relative to the space 7 receiving the staple or pin (see FIG. 1 or 7). A modification consists in placing the slot 8 on the bias as in FIG. 17, the force of pulling apart the detachable portions being exerted principally upwardly, the staple or pin has the tendency to remain wedged in the space 7 and there is less risk of an undesired removal of the staple or pin. FIGS. 16 and 18 show another modification of the slot 8 in the form of a letter J, this modification, FIG. 19, has a slot 8 of a width greater than the diameter of the pin or staple for easy sliding, the staple or pin is in this case retained in the space 7 by the spring force of a resilient material 19 suitably arranged. In this latter case, the material of the resilient receiver 4 may be inelastic.

Figure 15:
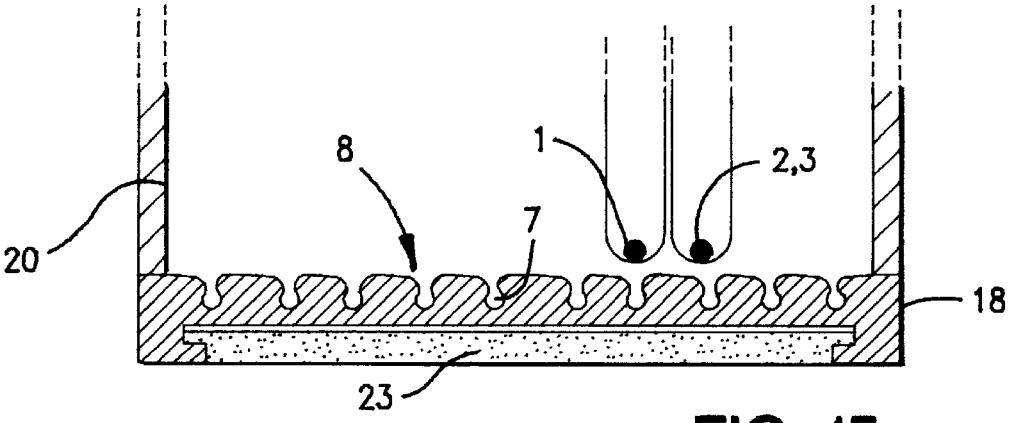
FIG. 15 shows, in a side view, the binder with a flexible back and means to render it rigid.

The overall binder may if desired have a flexible back 25, FIGS. 1, 11, 13, 14, which can be elastic and made of a rubber material or the like to permit giving to the back of the overall binder the shape of the arc of a circle by pressing with the fingers on the receivers, a non-slip device 18 can be provided, FIG. 15. This forms the arc of a circle and facilitates insertion of the detachable portions by increase of the available space and enlargement of the slots of the receivers. The return into straight position contributes to regrip and lock the staple or pin in its recess. A locking of the flexible back 25 in straight position can be provided with a wedging system 23, FIG. 15, a hinge system 27, FIGS. 1, 11, 13, 14 and automatic wedging 10, FIGS. 1, 13, manipulable with the help of a lug 11, FIGS. 1, 14, and lockable with the help of a push button type system, not shown. The locking of the back can also be obtained by the presence of a return or included member serving as a spring, by a curved and stable elastic member which can take a stable inverted position as well (locking, unlocking of the receivers), an example of this device being used as a cap to maintain the hair. Finally, this locking can be obtained by suitable elastic tension of the material of the back of the overall binder.

Figure 20:
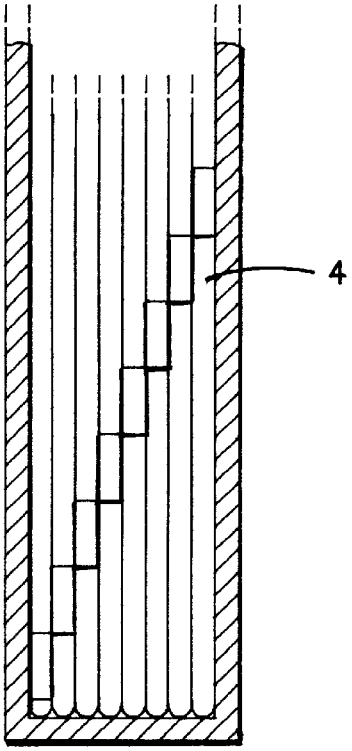
FIG. 20 shows in a side view an indexing means for the emplacement of the detachable portions in the binder.
Figure 21:
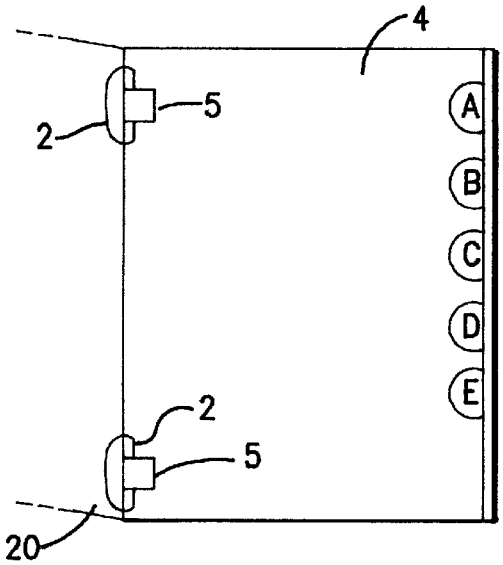
FIG. 21 shows the open view with an index which can be used to select the detachable portions, as well as a view while opening the cover of the binder

The detachable portions are provided with one or several visual indices, colors, designs, figures printed on the section, for example see FIG. 20, or tactile such as recesses, lugs, indices, etc . . . These various indexing means can be combined with each other and even repeated corresponding to the position of the receivers.

Figure 22:
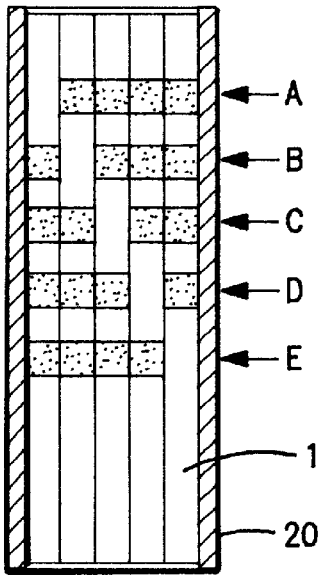
FIG. 22 is a side view.

A tactile and visual means that is particularly suitable for indexing, detaching and reinserting the detachable portions, consists in marking with the letter A, the edge of the first portion, hollowing out all the others correspondingly, marking with the letter B in a spaced manner the second detachable portion, hollowing out the others correspondingly, and so on. By this means, there can be seized by pinching between two fingers the detachable portion desired and separating it from the others in a manner shown in FIG. 21 see from above and FIG. 22 shown in side view, showing the hollowed out portions with marking of 5 detachable portions from A to E.

Figure 23:
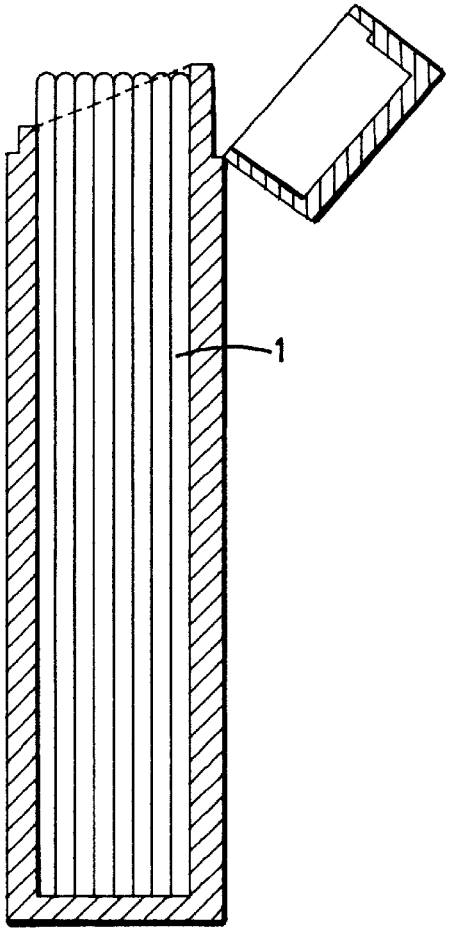
FIG. 23 is a view showing the concept of dividing a book into independent detachable portions.

The provided detachable portions, with the aid of the overall cover, to reconstitute a book or a classification system, can also be interposed in classification boxes as shown in FIG. 23 or in a box open on one surface, leaving visible the indexing system, it is possible thereby to select certain ones from among others and to integrate them into the overall binder which then serves as protection for transportation (in the case of a large quantity of documents interposed in several boxes as needed).

Conversely, there can be selected one or several detachable portions from this overall cover for removing them, reclassifying them otherwise, bringing them to a work site or an inspection station, etc . . .

Figure 24:
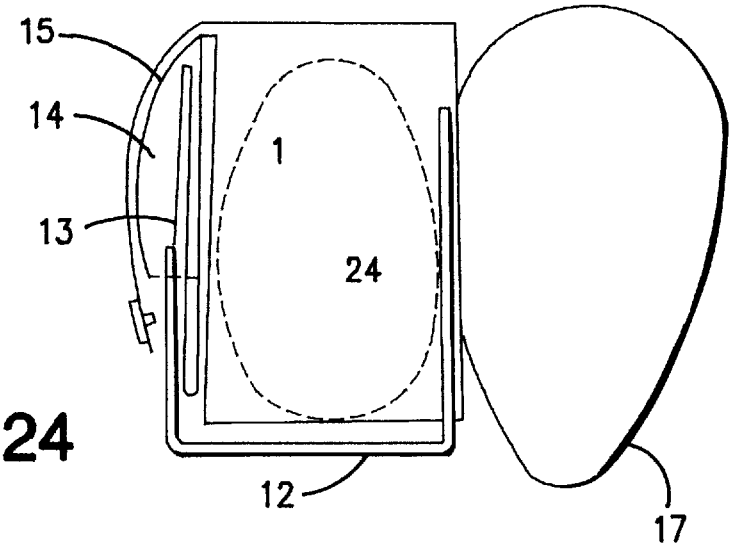
FIG. 24 is a side and crosssectional view of a backpack of variable volume that can be used in association with the invention for carrying the detachable portions, in the folded position.
Figure 25:
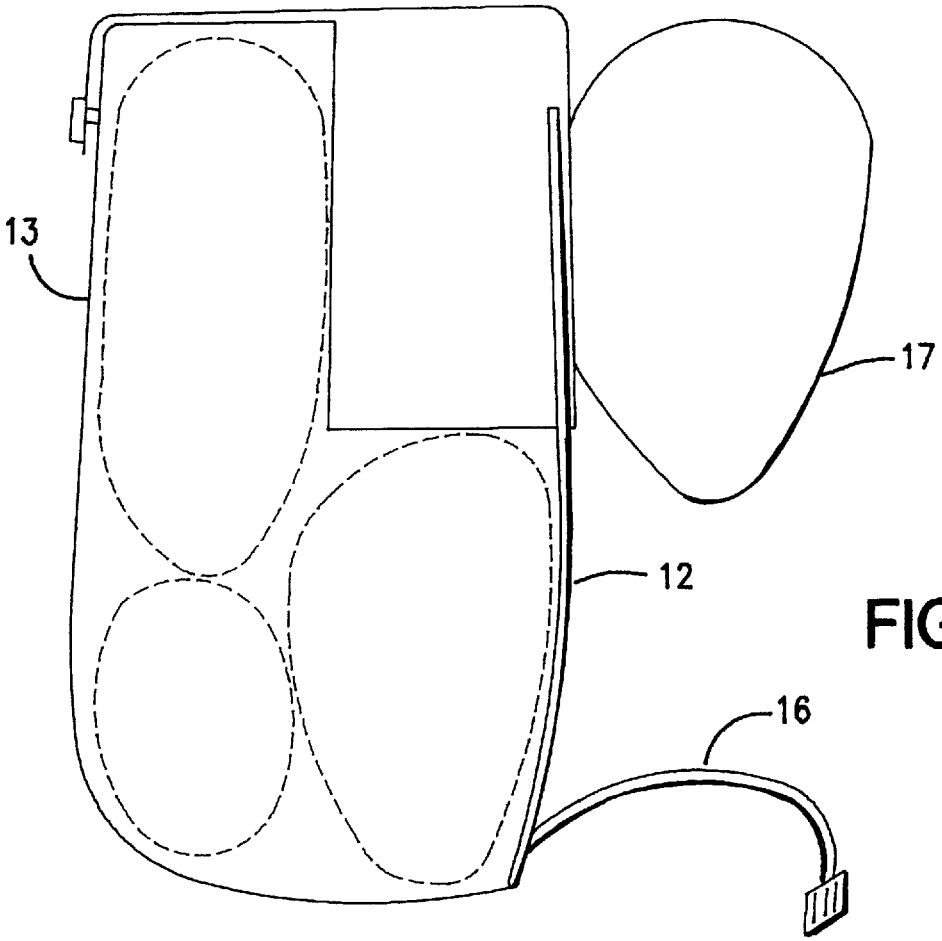
FIG. 25 is the same in unfolded position.

The detachable portions can then be transported in a backpack or trundle pack, FIGS. 24, 25, comprising indexed compartments, FIG. 24 (history, mathematics, for example) so as to avoid searching, handling, wear, and of course the compartments necessary for the usual objects, a compass, pens and notebooks (indexing by an index, visual means, colors, letters, figures, titles, tactile means). The indices on the sack compartments can be selected identically to those of the detachable portions 1 (same color for example).

These indexed compartments could be provided in another known system of the type of bellows indices, suspension files, etc . . . with a depth if desired less than the height occupied by a detachable portion in the bag. Thus the outwardly extending portion could comprise one title or the like, repeating and confirming the indexing of the compartments, even its replacement if the subject of the detachable portion 1 has not been provided in the bag or if the indexing has been judged useless in certain situations. The dimensions and materials of these bags or trundles are of course optimized with a view toward maximum lightening. Users of the bag described above, FIG. 24, may occasionally need room to transport other objects than books, particularly outer garments, shoes and sporting materials. Thus the sack described above, FIG. 24, can be integrated into a larger sack with the drawback of the weight and size. To overcome this, flexible frames 12, FIGS. 24, 25, disposed vertically, secured to the back described above, articulated or made of a rigid material in one direction, flexible in another direction, such as certain metallic alloys, composite materials, incurved blades in the form of gutters, etc . . . , bendable or flexible or resilient frames, permitting automatic return into straight position, will be used as supports for a large pocket 13, FIGS. 24, 25, comprising in its thickness or even sewn in, elastic bands returning it easily to the position 14 in FIG. 24, if desired in a protective pocket of elastic cloth 15, FIG. 24.

These flexible frames could also support a back pad and a belt 16, FIG. 25, permitting the securement of the assembly on the hips and hence the shifting of the weight to the pelvis (principle of mountain bags). There is also shown adjustable shoulder straps (of the backpack type 17, FIGS. 24, 25). The pocket 13, FIG. 24, will be provided with back or side openings for practical purposes. The assembly will be dimensioned as a function of anatomical needs of the users.

School notebooks themselves for lightening purposes could be in the form of detachable portions 1 matched with a suitable binding.

The present invention is adapted to permit the production of separable documents, limiting the carrying and handling to the portions necessary for work in progress and avoiding the unneeded transportation of heavy documents. By its simplicity in the simplest versions, it is particularly useful for school books. By its adaptable and multivarious character, it is also suitable for all systems of arrangement of documents, magazines, loose-leaves, etc . . . ; it permits the reconstruction of works by replacement of the out-of-date portions, stepwise building, easier replacement of worn or lost portions, etc . . .

The present invention provides constructing a connected document such as a school book, catalog, etc . . . separable in independent detachable portions, so as not to have to transport but the useable portion or portions to be able to file, reclassify, replace, complete these independent subassemblies without having to manipulate all of the document, comprised by a cover and detachable portions (1) such as notebooks, magazines, pockets for loose-leaves, provided with securement means coacting in a detachable manner with complementary reception means secured to the cover of the document, characterized by the use, to ensure the securement of the detachable portions (1), of staples (2) or pins (3) secured to the back of these portions (1) by the use of resilient receivers (4) fixed within the back of the cover, in combination with recesses (5) provided in the staples (2) or pins (3) adapted to be engaged in the receivers (4).

I claim:

1. Connected document comprising a plurality of independent detachable portions, each of said detachable portions having on one of its edges fastening means adapted to be inserted into a resilient receiving member, said fastening means comprising at least one recess defining an open end which is closed by a metallic rod secured to the detachable portion and adapted to be inserted via a slot in a space of the resilient receiving member.

2. Document according to claim 1, wherein the metallic rod is the body of a staple secured to the detachable portion by its bent ends.

3. Document according to claim 2, wherein the ends of the staple are bent inwardly towards the recess portion.

4. Document according to claim 2, wherein the bent ends of the staple are separated by a distance at least equal to the width of the recess.

5. Document according to claim 1, wherein the resilient receiving member comprises a resilient material.

6. Document according to claim 1, wherein the resilient receiving member comprises a non-resilient material, and a resilient device bordering said space.

7. Document according to claim 1, wherein the slot is straight and extends in a direction parallel to the detachable portion when the document is closed.

8. Document according to claim 1, wherein the slot is biased and extends in a direction oblique to the detachable portion when the document is closed.

9. Document according to claim 1, wherein the slot and the space of the receiving member have the shape of the letter J.

10. Document according to claim 5, wherein the slot has joining edges.

11. Document according to claim 1, wherein the document further comprises a cover, and the receiving member is secured to the cover.

12. Document according to claim 11, wherein the cover has a back in which the resilient receiving members are secured.

13. Document according to claim 12, wherein the back and the receiving members constitute a single piece.

14. Document according to claim 12, wherein the back is rigid.

15. Document according to claim 12, wherein the back is flexible, and the document further comprises an automatic wedging system for maintaining the cover pages parallel when the document is closed.

16. Document according to claim 15, wherein the slot has opposite edges which join each other when the document is closed.

17. Document according to claim 1, further comprising a visual index constituted by hollowed out portions positioned in a spaced manner on the edge of each detachable portion.

18. Document according to claim 1, wherein the recess and the receiving member of a detachable portion are offset with respect to the recess and the receiving member of each other detachable portion.

19. Document according to claim 1, further comprising means for ensuring a longitudinal positioning of the detachable portions with respect to the receiving members.

20. Document according to claim 19, wherein the width of the recesses corresponds to the thickness of the receiving members.

21. Document according to claim 19, wherein the longitudinal positioning is ensured by staples.

22. Document according to claim 12, wherein the receiving members are disposed on a plate secured to the back of the cover.

23. Document according to claim 2, wherein the detachable portion comprises several pages assembled by the staple.

* * * * *